US011705681B2

(12) United States Patent
Patel

(10) Patent No.: US 11,705,681 B2
(45) Date of Patent: Jul. 18, 2023

(54) FIELD TERMINABLE ETHERNET CONNECTOR WITH INTEGRAL TERMINATION CAP

(71) Applicant: Panduit Corp., Tinley Park, IL (US)

(72) Inventor: Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 28 days.

(21) Appl. No.: 17/445,429

(22) Filed: Aug. 19, 2021

(65) Prior Publication Data

US 2023/0057001 A1 Feb. 23, 2023

(51) Int. Cl.

| | |
|---|---|
| ***H01R 13/60*** | (2006.01) |
| ***H01R 24/64*** | (2011.01) |
| ***H01R 11/11*** | (2006.01) |
| ***H01R 13/58*** | (2006.01) |
| ***H01R 13/50*** | (2006.01) |

(52) U.S. Cl.

CPC ..... *H01R 24/64* (2013.01); *H01R 11/11* (2013.01); *H01R 13/501* (2013.01); *H01R 13/5829* (2013.01)

(58) Field of Classification Search

CPC ..... H01R 24/64; H01R 11/11; H01R 13/501; H01R 13/5829; H01R 13/20; H01R 12/88; H01R 12/616; H01R 12/67; H01R 12/675; H01R 4/24; H01R 4/2404; H01R 4/2416; H01R 4/2445; H01R 4/2466; H01R 4/2491; H01R 4/2495; H01R 4/70; H01R 4/031; H01R 4/40; H01R 9/053

USPC ..... 439/676

See application file for complete search history.

(56) References Cited

U.S. PATENT DOCUMENTS

| | | | | |
|---|---|---|---|---|
| 3,879,099 | A * | 4/1975 | Shaffer | H01R 12/675 439/470 |
| 4,995,830 | A | 2/1991 | Eckhaus | |
| 5,947,761 | A * | 9/1999 | Pepe | H01R 4/2433 439/942 |
| 6,074,238 | A * | 6/2000 | DeRoss | H01R 13/5833 439/409 |
| 6,080,006 | A | 6/2000 | Broder | |
| 6,116,943 | A * | 9/2000 | Ferrill | H01R 24/64 439/418 |
| 6,682,363 | B1 * | 1/2004 | Chang | H01R 24/64 439/409 |
| 7,066,764 | B2 | 6/2006 | Bolouri-Saransar | |
| 7,572,140 | B2 | 8/2009 | Szelag et al. | |
| 7,713,081 | B2 * | 5/2010 | Chen | H01R 9/0527 439/468 |
| 7,815,462 | B2 * | 10/2010 | Boeck | H01R 13/6658 439/409 |
| 8,070,506 | B2 * | 12/2011 | De Dios Martin | H01R 4/2433 439/409 |
| 8,192,224 | B2 | 6/2012 | Schmidt et al. | |
| 9,033,725 | B2 * | 5/2015 | Fransen | H01R 13/6585 439/409 |
| 9,537,226 | B2 * | 1/2017 | Krome | H01R 24/64 |

(Continued)

*Primary Examiner* — Harshad C Patel

(74) *Attorney, Agent, or Firm* — Christopher S. Clancy; James H. Williams; Christopher K. Marlow

(57) ABSTRACT

A connector has a plug housing and a termination cap housing assembly pivotably attached to the plug housing. The termination cap housing assembly has a pair of contacts secured thereto such that pivoting the termination cap housing assembly to the plug housing terminates the contacts to a pair of wires inserted into the plug housing.

3 Claims, 16 Drawing Sheets

(56) References Cited

U.S. PATENT DOCUMENTS

| | | | | |
|---|---|---|---|---|
| 9,601,886 | B1 * | 3/2017 | Fransen | H01R 13/6466 |
| 9,960,549 | B2 | 5/2018 | Strelow et al. | |
| 10,033,118 | B2 * | 7/2018 | Jager | H01R 24/64 |
| 10,056,703 | B2 * | 8/2018 | Gatnau Navarro | H01R 4/2416 |
| 10,224,675 | B2 * | 3/2019 | Lin | H01R 24/64 |
| 10,490,960 | B1 * | 11/2019 | Wu | H01R 4/242 |
| 2008/0050965 | A1 * | 2/2008 | Szelag | H01R 13/6658 439/387 |

* cited by examiner

FIELD TERMINABLE ETHERNET CONNECTOR WITH INTEGRAL TERMINATION CAP

FIELD OF THE INVENTION

The present invention relates generally to electrical connectors and more specifically to an electrical connector for single pair ethernet with a hinged termination.

BACKGROUND

Copper connectors are becoming increasingly compact in an effort to achieve a higher density of data channels in a given area, as well as for use in applications where data needs to be transmitted to remote devices, such as security cameras and climate control devices. These compact connectors are generally required to be installable onto cable in the field using simple hand operated tools. Typically, for an ethernet data connection, a four pair cable solution would be deployed using RJ45 jacks as the interconnection. However the full bandwidth of a Cat 6a system is not necessary for low bandwidth applications such as, but not limited to, sensors, lights, and other smart building devices. In this case, a single twisted pair cabling solution can be deployed that will save material costs as well as reduce the amount of space used by the structured cabling system. With the recent advancements of ethernet bandwidths using copper media, the data throughput will be adequate for most smart devices. The field terminable design provides an advantage by allowing installers to build custom cabling structures and only use the necessary amount of cable for the end user's application. This customization eliminates the need for additional cabling management techniques which saves time and resources for field technicians deploying the structured cabling system.

What is needed is a connector design having a minimum number of pieces that the customer handles and is easy to terminate and unterminate without complex and expensive tools.

SUMMARY OF THE INVENTION

A connector has a plug housing and a termination cap housing assembly pivotably attached to the plug housing. The termination cap housing assembly has a pair of contacts secured thereto such that pivoting the termination cap housing assembly to the plug housing terminates the contacts to a pair of wires inserted into the plug housing.

DESCRIPTION OF THE INVENTION

The present invention is a single pair ethernet plug based on a fiber LC connector form factor due to its compact size, low cost, and ease of manufacturability. The plug features a two piece, toolless termination method for quick installation and ability to be quickly disassembled for retermination onto a new cable.

Figure 1:
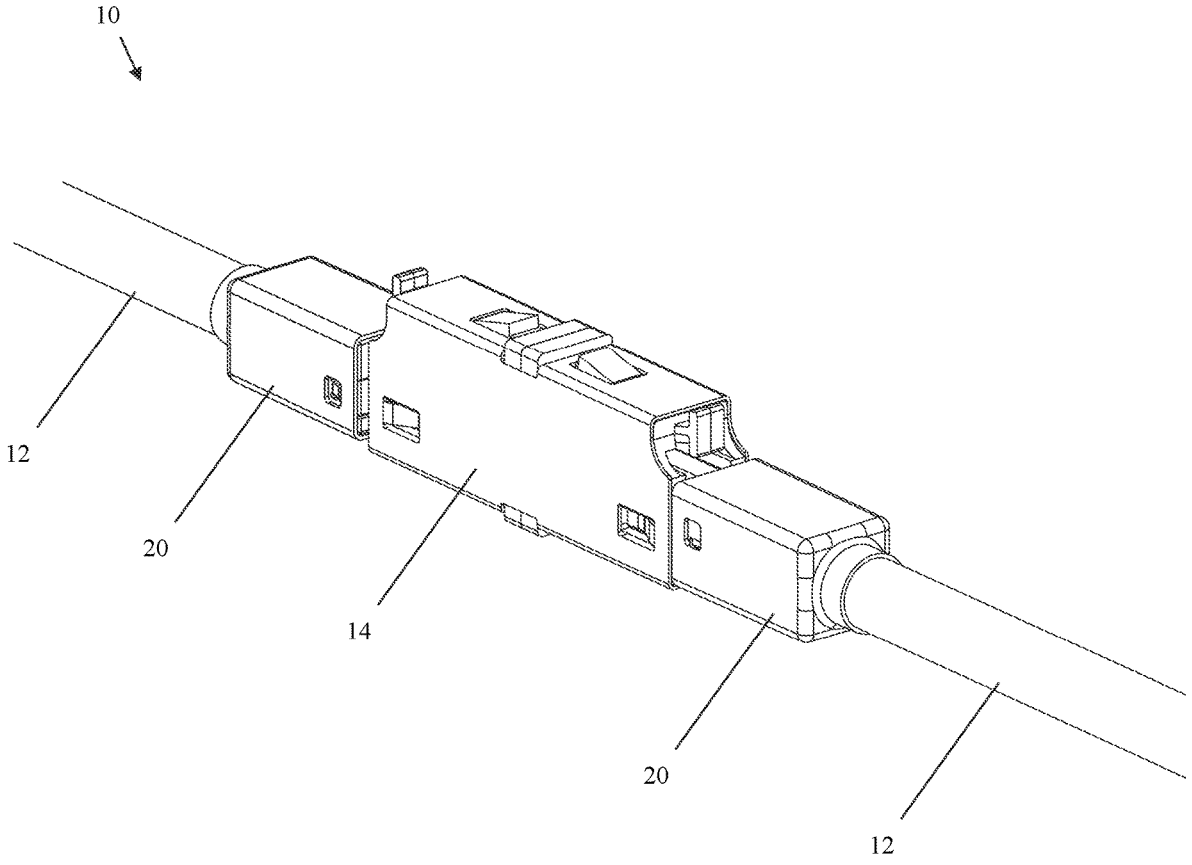
FIG. 1 is a trimetric view of a communications channel.

FIG. 1 is a trimetric view of communications channel 10, which includes Single Pair Ethernet (SPE) cables 12 terminated to SPE plugs 20 connected by SPE coupler 14. Communications channel 10 can be located in cabinets, racks, zone enclosures, and other such infrastructure. SPE plug 20 is shown mated to SPE coupler 14 but it can be mated to SPE connector on Switch, patch panel or to the SPE connector on end device.

Figure 2:
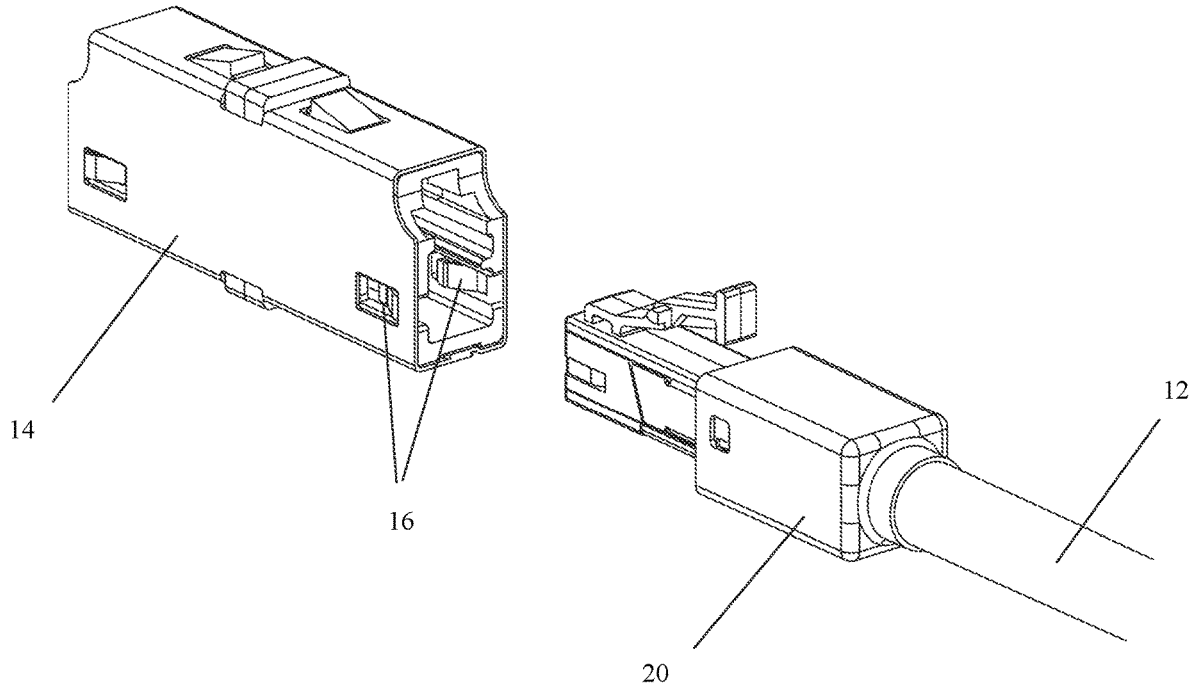
FIG. 2 is a trimetric view showing an unmated coupler and single pair ethernet plug (SPE) terminated to a cable.

FIG. 2 is a trimetric view showing unmated coupler 14 and SPE plug 20 terminated to cable 12. Far end SPE plug and cable is not shown in this view. Coupler 14 shield tabs 16 interface with SPE plug 20 shield to provide end-to-end shield continuity.

Figure 3:
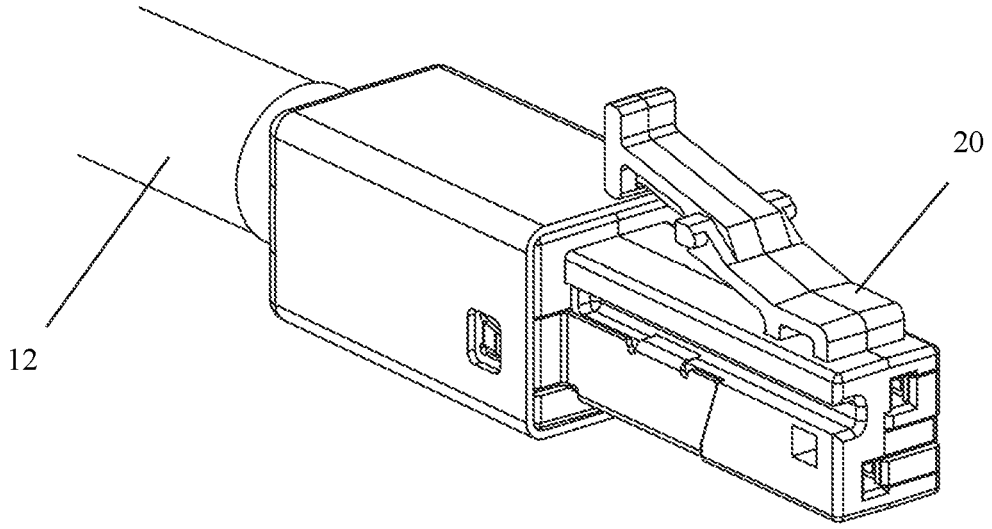
FIG. 3 is a 180° rotated trimetric view of the SPE plug in FIG. 2 terminated to the cable.

FIG. 3 is a 180° rotated trimetric view of SPE plug 20 terminated to cable 12.

Figure 4:
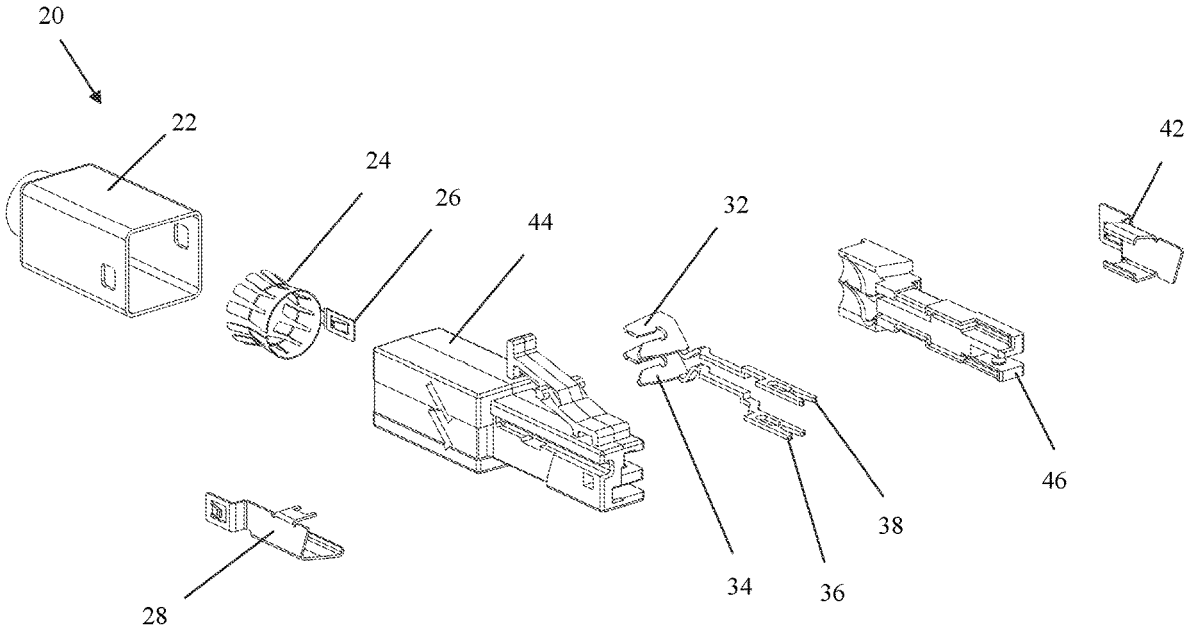
FIG. 4 is a 180° rotated trimetric exploded view of the SPE plug.

FIG. 4 is a 180° rotated trimetric exploded view of SPE plug 20. SPE plug 20 includes end cap 22, cable interface shield 24, retaining tab 26, plug housing 44, plug housing shield wrap 28, contacts 36 and 38, termination cap housing 46 and termination cap shield wrap 42. Contacts 36 and 38 include insulation displacement contacts (IDCs) 32 and 34.

Figure 5:
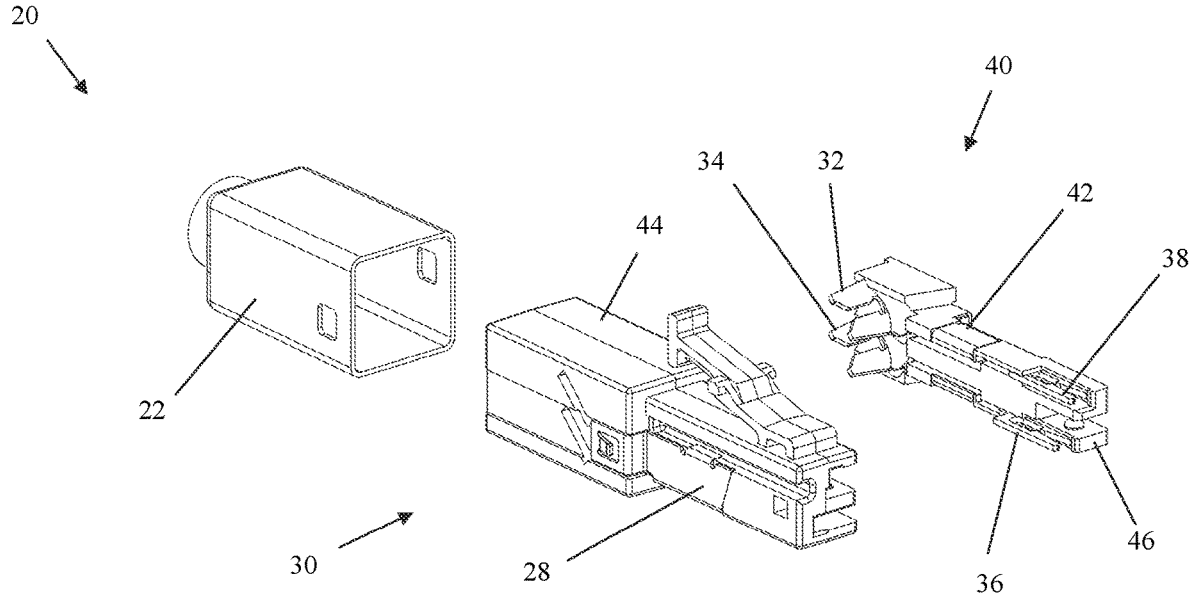
FIG. 5 is a 180° rotated trimetric partially assembled exploded view of the SPE plug.

FIG. 5 is a 180° rotated trimetric partially assembled exploded view of SPE plug 20. Termination cap assembly 40 is an assembly of contacts 36 and 38, termination cap shield wrap 42 and termination cap housing 46. Contacts 36 and 38 are firmly attached to the termination cap housing 46 using attachment methods such as mechanical bonding, ultrasonic welding, heat staking or similar methods. The plug housing assembly 30 is an assembly of plug housing shield wrap 28, cable interface shield 24 and plug housing 44.

Figure 6:
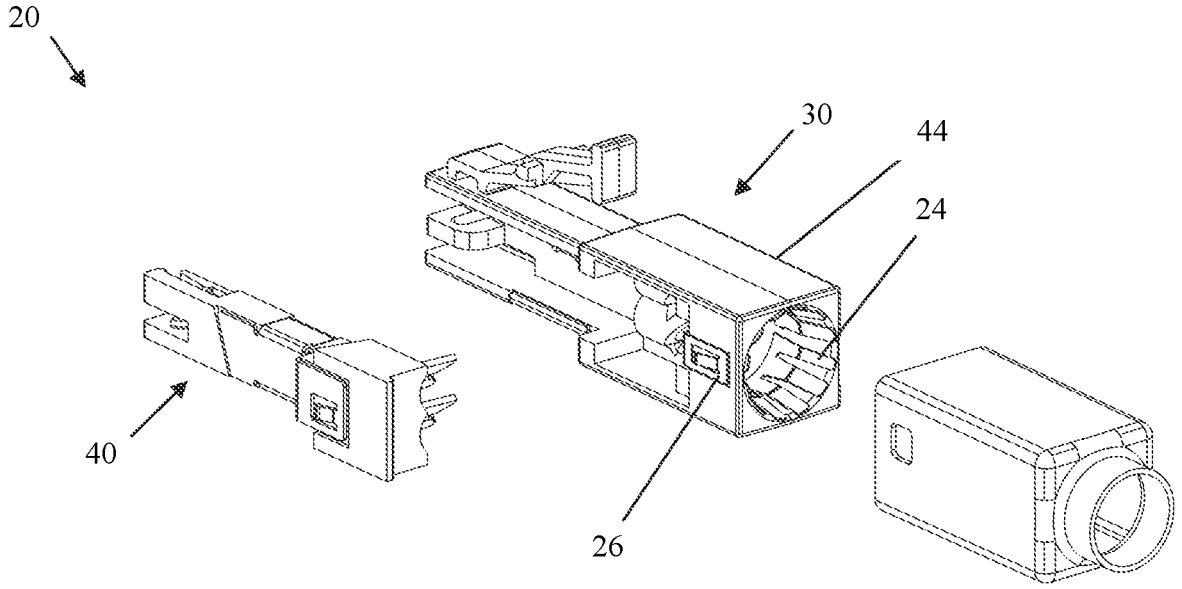
FIG. 6 is a trimetric exploded view of SPE plug.

FIG. 6 is a trimetric exploded view of SPE plug 20. It shows cable interface shield 24 assembled to plug housing 44. Retaining tab 26 is formed over plug housing 44. Retaining tab 26 prevents cable interface shield 24 from backing out.

Figure 7:
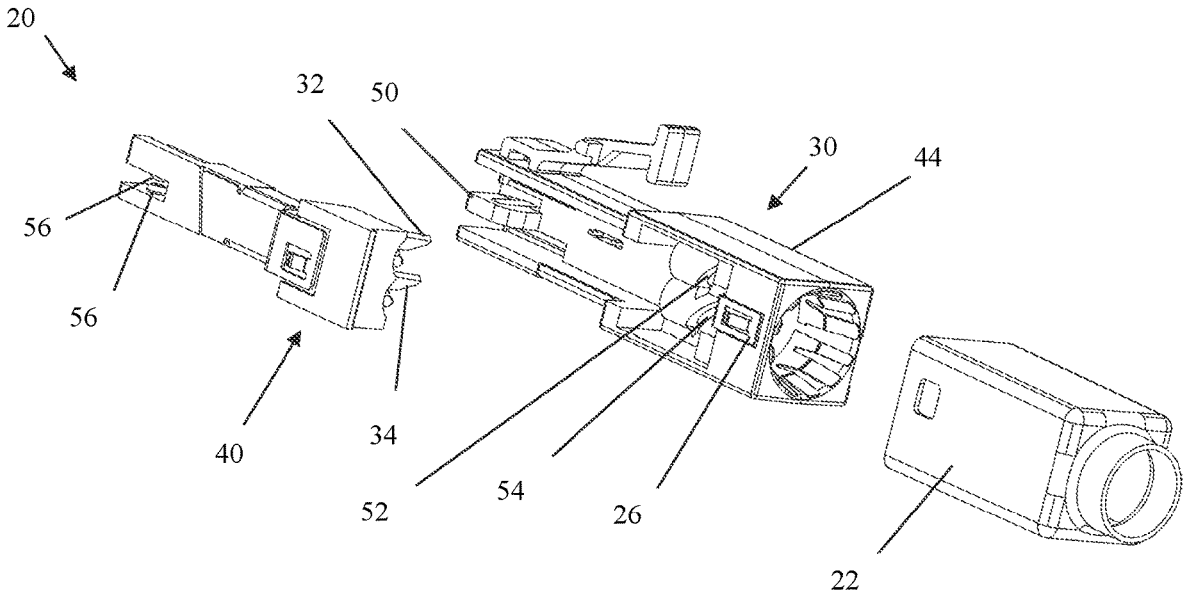
FIG. 7 is an axially rotated exploded view of the SPE plug.

FIG. 7 is an axially rotated exploded view of SPE plug 20. The plug housing 44 hinge socket 50 is designed to accept termination cap assembly 40 front upper and lower pivot dimples 56. When assembled, termination cap assembly 40 hinges around axis passing through center of upper and lower pivot dimples 56. IDCs 32 and 34 protrude through contact slots 52 and 54 during termination.

Figure 8:
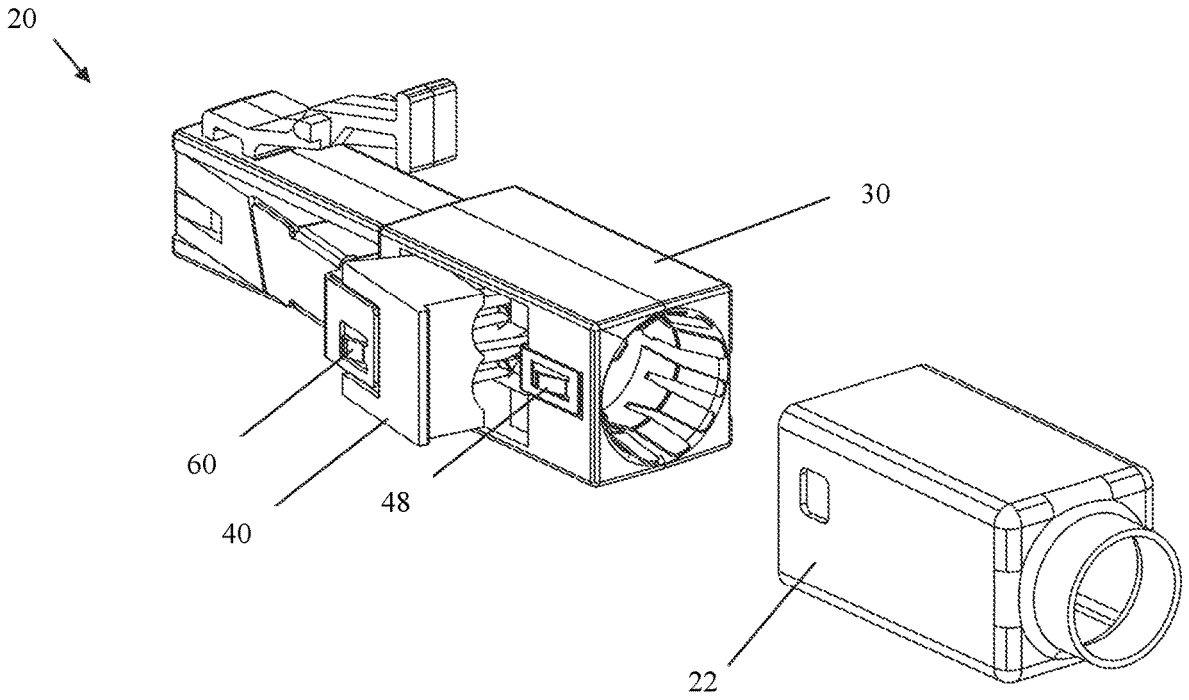
FIG. 8 is a trimetric view of the plug housing assembly assembled to the termination cap assembly of the SPE plug.

FIG. 8 is a trimetric view of plug housing assembly 30 assembled to termination cap assembly 40. Termination cap shield tabs 60 and cable interface shield tab 48 interface with conductive end cap 22 inner face to provide shield continuity.

Figure 9:
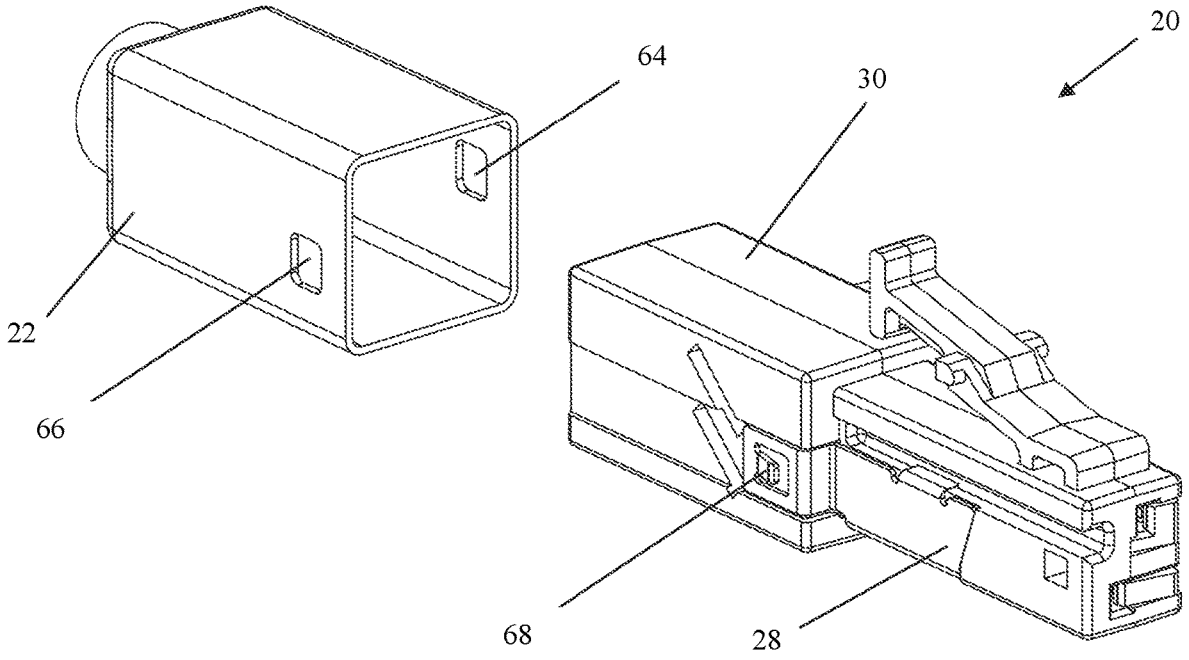
FIG. 9 shows a plug housing shield tab and end cap latch windows.

FIG. 9 shows plug housing shield tab 68 and end cap 22 latch windows 64 and 66. End cap 22 latch windows 64 and 66 location allows end cap 22 to be assembled to plug housing assembly 30 without requiring specific orientation. Plug housing shield tab 68 prevents end cap 22 from backing out and provides shield continuity between plug housing shield wrap 28 and end cap 22.

Figure 10:
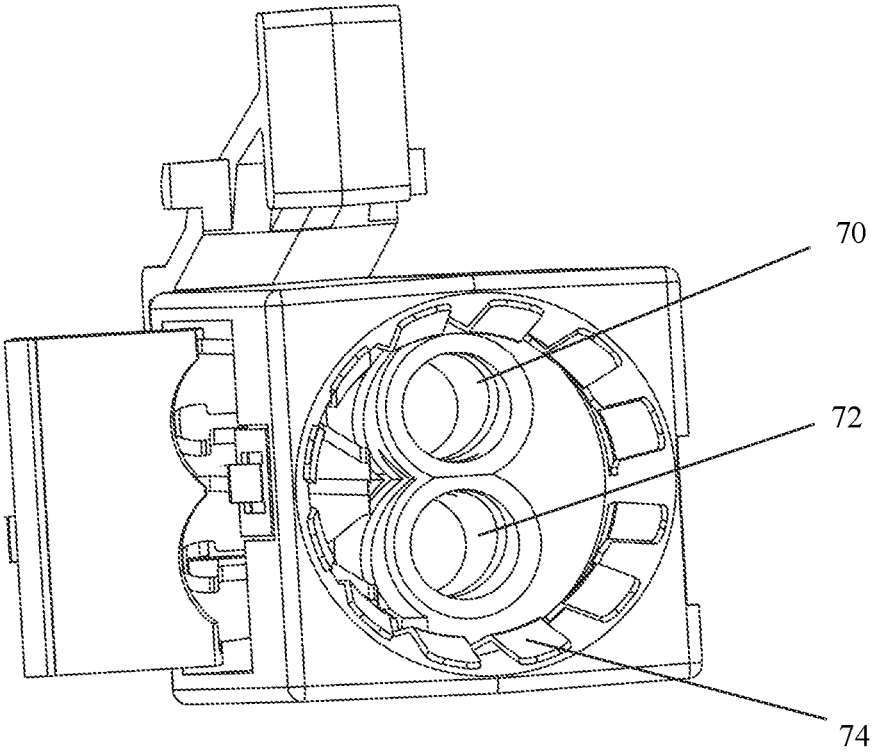
FIG. 10 shows an isometric tilted view showing wire tunnels.

FIG. 10 shows isometric tilted view showing wire tunnels 70 and 72. Wire tunnels 70 and 72 position conductors for termination and keep them separated from each other. While undoing termination, wire tunnels hold conductors in place and allow IDC pull out. Cable interface shield fingers 74 are designed to create spring pressure on cable jacket.

FIGS. 11 thru 14 show plug assembly steps.

Figure 11:
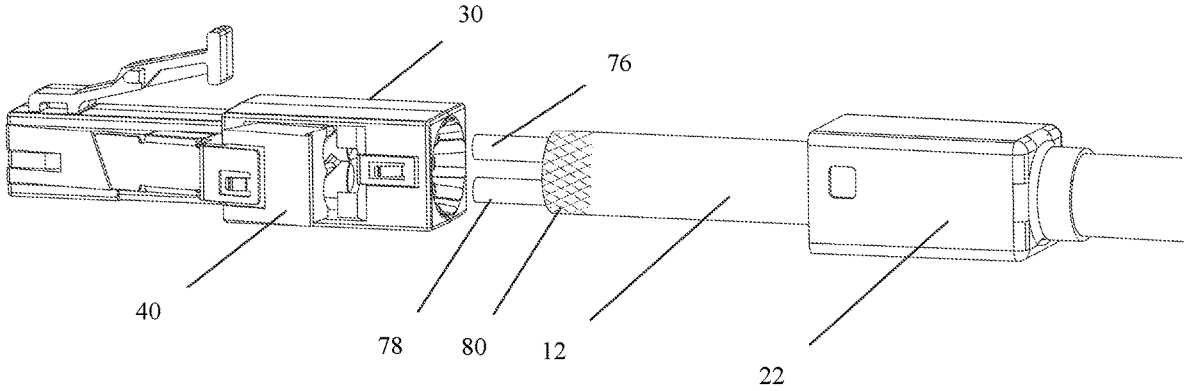
FIG. 11 shows an assembly step.
Figure 12:
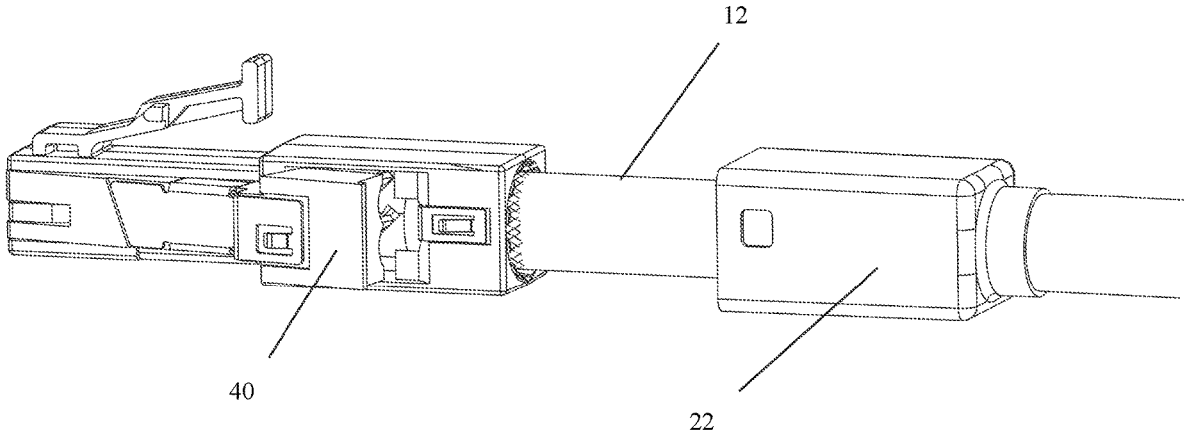
FIG. 12 shows the assembly step after FIG. 11.

As shown in FIG. 11 and FIG. 12, end cap 22 is threaded onto cable 12. Cable 12 jacket is stripped, cable shield 80 is pulled back over the cable jacket, conductors 76 and 78 are cut to length and oriented to align with the proper IDC position. Cable shield 80 can be braid, metallic foil or metal wire. If foil shield is used, bare metal side should face outside on pulled back surface. If drain wire is present, it should be wrapped around the jacket in interface area. FIG. 12 shows cable 12 conductors 76 and 78 inserted into wire tunnels 70 and 72. Cable jacket portion having braid pulled over the jacket fits into SPE plug 20 rear opening. SPE plug 20 rear opening and cable braid shield create snug fit to provide gas-tight connection between cable shield 80 and cable interface shield 24. Cable interface shield 24 fingers 74 create spring pressure on cable shield 80. Termination cap assembly 40 is ready to be pressed flush to terminate conductors 76 and 78.

Figure 13:
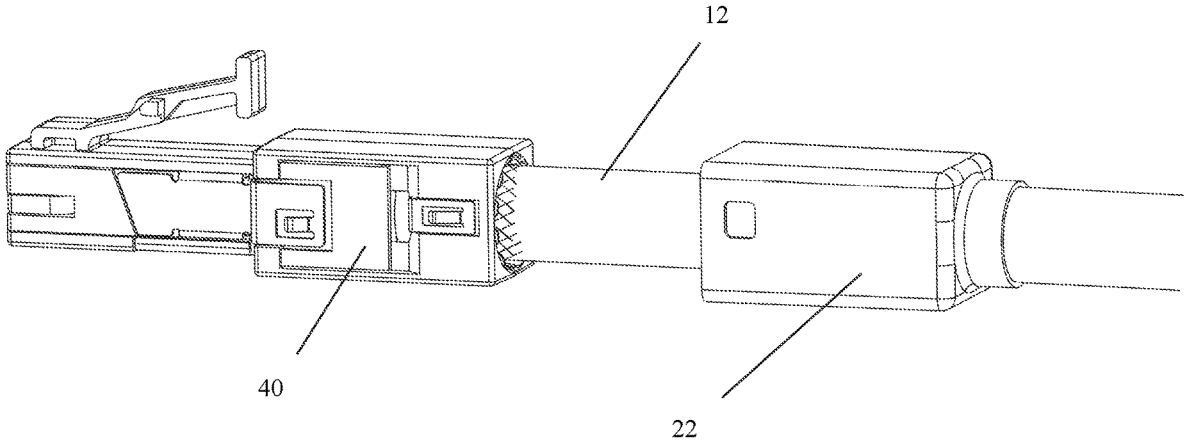
FIG. 13 shows the assembly step after FIG. 12.

FIG. 13 shows termination cap assembly 40 pressed flush.

Figure 14:
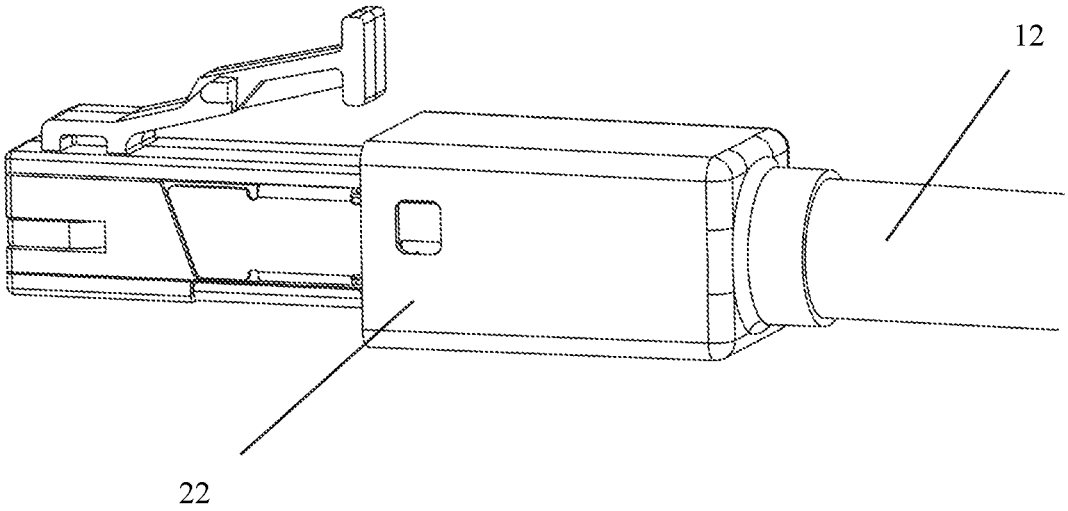
FIG. 14 shows the assembly step after FIG. 13.

FIG. 14 shows end cap 22 snapped in place. End cap 22 prevents termination cap from coming loose and connects cable shield 80 to plug housing shield wrap 28 and termination cap shield wrap 42.

The single pair ethernet plug may be offered in a non-shielded version as a lower cost solution for applications that do not require the performance of a shielded system.

Figure 15:
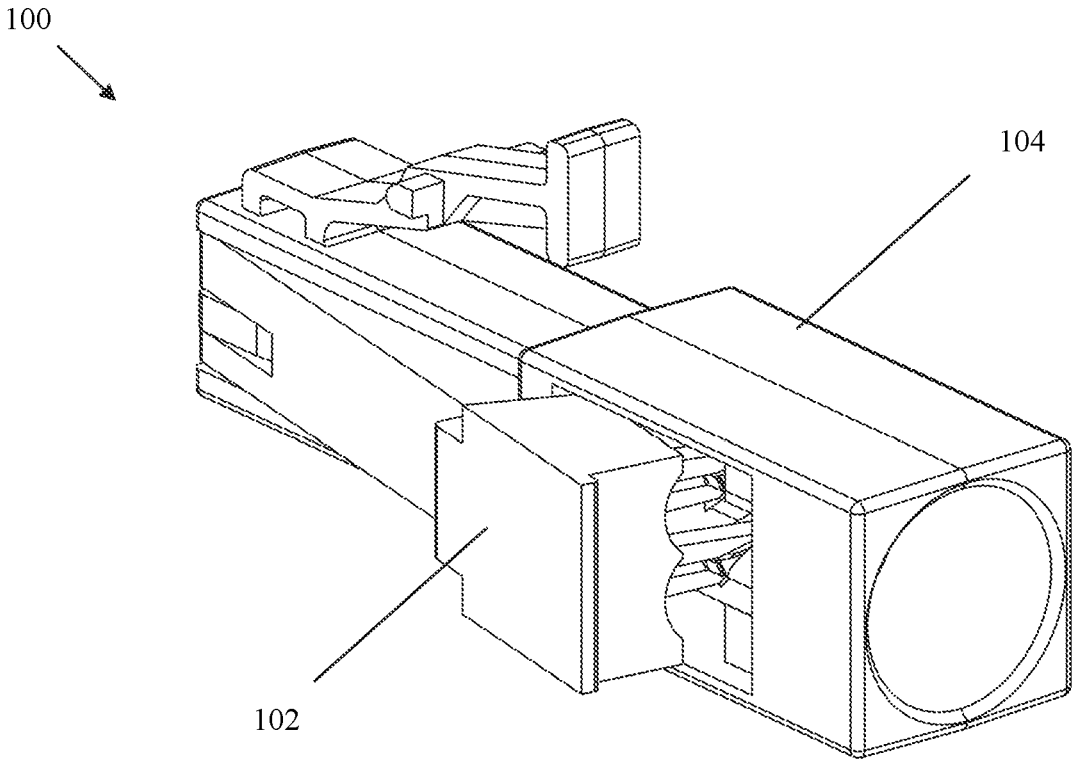
FIG. 15 is a trimetric view of an SPE unshielded plug.
Figure 16:
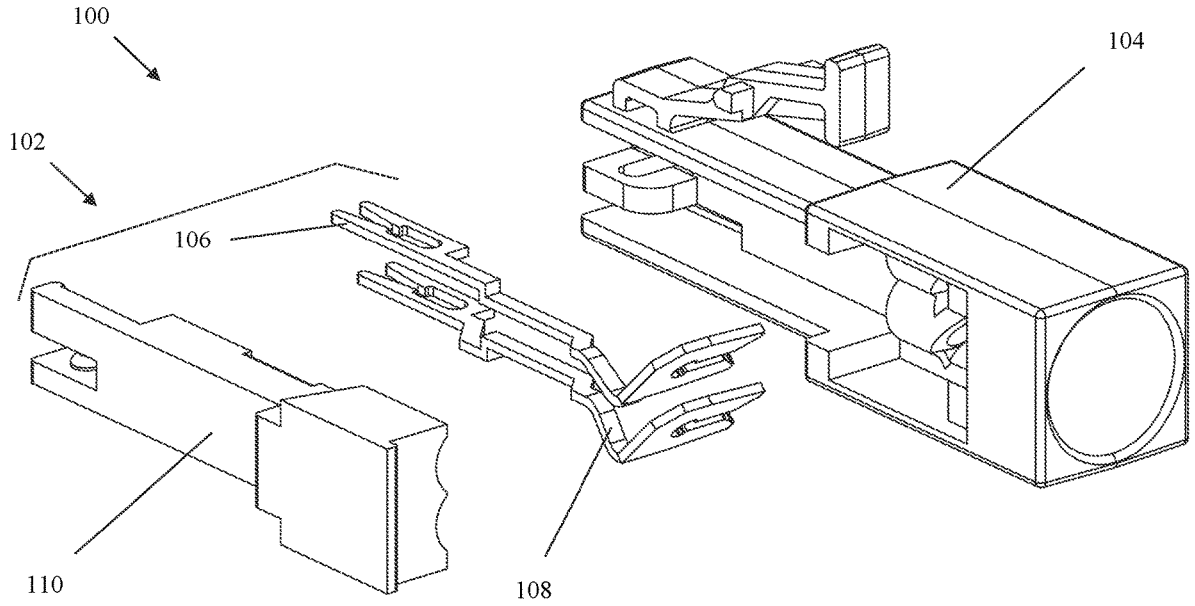
FIG. 16 is an exploded view of SPE unshielded plug.

FIG. 15 is a trimetric view of SPE unshielded plug 100. FIG. 16 is an exploded view of SPE unshielded plug 100. SPE unshielded plug 100 includes termination cap assembly 102 and plug housing 104. Termination cap assembly 102 consists of termination cap housing 110 and contacts 106 and 108. Unshielded single pair ethernet plug 100 assembly and termination method is the same as SPE plug 20 excluding shield related assembly and termination steps.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A connector comprising:

a plug housing;

a termination cap housing assembly pivotably attached to the plug housing, the termination cap housing assembly having a pair of contacts secured thereto such that pivoting the termination cap housing assembly to the plug housing terminates the contacts to a pair of wires inserted into the plug housing;

an end cap partially surrounding the plug housing and the termination cap housing assembly such that it assists in keeping the termination cap housing assembly secured to the plug housing; and a plug housing shield partially surrounding the plug housing and having a plug housing shield tab and a termination cap shield having a termination cap shield tab wherein the end cap is conductive and makes contact with the plug housing shield tab and the termination cap shield tab to maintain shield continuity.

2. The connector of claim 1 further comprising a cable interface shield inserted into a rear of the plug housing and configured to surround an inserted cable and contact a shield of the inserted cable, the cable interface shield having a cable interface shield tab configured to make contact with the end cap to maintain shield continuity.

3. The connector of claim 2 wherein the cable interface shield tab is also configured to engage the plug housing to prevent the cable interface shield from backing out of the plug housing.

* * * * *